US007726083B2

(12) United States Patent
Wagner

(10) Patent No.: US 7,726,083 B2
(45) Date of Patent: Jun. 1, 2010

(54) CURTAIN-TYPE FACADE STRUCTURE

(75) Inventor: Rudolf Wagner, Straubing (DE)

(73) Assignee: Moeding Keramikfassaden GmbH (DE)

( * ) Notice: Subject to any disclaimer, the term of this patent is extended or adjusted under 35 U.S.C. 154(b) by 234 days.

(21) Appl. No.: 11/777,725

(22) Filed: Jul. 13, 2007

(65) Prior Publication Data

US 2008/0010922 A1 Jan. 17, 2008

(30) Foreign Application Priority Data

Jul. 14, 2006 (DE) ..... 10 2006 033 045

(51) Int. Cl.
*E04H 1/00* (2006.01)

(52) U.S. Cl. ..... 52/235; 52/243; 52/506.05; 52/281; 52/285.3; 52/489.1

(58) Field of Classification Search ..... 52/235, 52/236.7, 236.9, 243, 506.05, 506.06, 511, 52/513, 281, 285.3, 285.4, 489.1, 489.2
See application file for complete search history.

(56) References Cited

U.S. PATENT DOCUMENTS 1,938,680 A * 12/1933 Balduf ..... 52/346
2,317,907 A * 4/1943 Gent ..... 52/362
2,483,346 A * 9/1949 Maul ..... 52/597
2,831,222 A * 4/1958 Anderson ..... 52/489.1
2,962,783 A * 12/1960 Elder ..... 52/713
3,257,134 A * 6/1966 Boyd et al. ..... 403/279
3,300,924 A * 1/1967 Ashby et al. ..... 52/265
3,862,530 A * 1/1975 Martine ..... 52/281
4,106,251 A * 8/1978 Nelsson ..... 52/489.2
4,152,878 A * 5/1979 Balinski ..... 52/481.1
4,193,230 A * 3/1980 Piana ..... 52/92.2
4,439,970 A * 4/1984 Rosner ..... 52/511
4,502,256 A * 3/1985 Hahn ..... 52/63
4,683,622 A * 8/1987 Oehlke ..... 24/458
5,245,811 A * 9/1993 Knorr ..... 52/481.1
5,301,484 A * 4/1994 Jansson ..... 52/235
5,544,461 A * 8/1996 Sommerstein ..... 52/235

(Continued)

FOREIGN PATENT DOCUMENTS

DE 9000858 U 4/1990

(Continued)

OTHER PUBLICATIONS

European Search Report, EP 07 01 3770.

(Continued)

*Primary Examiner*—Richard E Chilcot, Jr.
*Assistant Examiner*—Matthew J. Gitlin
(74) *Attorney, Agent, or Firm*—Lerner, David, Littenberg, Krumholz & Mentlik, LLP

(57) ABSTRACT

A curtain-type facade structure is described, comprising a fixedly supported substructure of vertical or horizontal basic profiled supports and crossing horizontal or vertical profiled supports mounted thereon, panel holders which are fastened to the supporting profiles, and facade panels which are retained by means of the panel holders. The panel holder is composed of separate components, one of the components being designed as a basic holder and another of the components being designed as an elastic clip. The elastic clip latches with the basic holder and forms a seat for the facade panels.

23 Claims, 5 Drawing Sheets

U.S. PATENT DOCUMENTS

| | | | | |
|---|---|---|---|---|
| 5,740,644 | A * | 4/1998 | Menchetti | 52/281 |
| 5,860,257 | A * | 1/1999 | Gerhaher et al. | 52/235 |
| 5,881,508 | A * | 3/1999 | Irvine et al. | 52/177 |
| 6,055,787 | A * | 5/2000 | Gerhaher et al. | 52/546 |
| 6,170,214 | B1 * | 1/2001 | Treister et al. | 52/511 |
| 6,205,731 | B1 * | 3/2001 | Gerhaher | 52/506.01 |
| 6,226,947 | B1 * | 5/2001 | Bado et al. | 52/483.1 |
| 6,289,644 | B1 * | 9/2001 | Gerhaher | 52/235 |
| 6,289,646 | B1 * | 9/2001 | Watanabe | 52/506.01 |
| 6,315,489 | B1 * | 11/2001 | Watanabe | 403/381 |
| 6,491,172 | B2 * | 12/2002 | Chance et al. | 211/87.01 |
| 7,207,147 | B2 * | 4/2007 | Price et al. | 52/586.1 |
| 2001/0025463 | A1 * | 10/2001 | Rudduck | 52/474 |
| 2006/0265988 | A1 * | 11/2006 | Fujito et al. | 52/511 |

FOREIGN PATENT DOCUMENTS

| | | | |
|---|---|---|---|
| DE | 19852298 | | 5/2000 |
| DE | 20312122 | U | 12/2003 |
| EP | 1136632 | A1 * | 9/2001 |
| FR | 2678662 | | 1/1993 |
| GB | 2414029 | | 11/2005 |
| WO | 2004079127 | | 9/2004 |
| WO | 2006064268 | | 6/2006 |

OTHER PUBLICATIONS

Product Brochure from Moeding Keramikfassaden GmbH, "Moeding Clay-Tile Facade", horizontal format design, curtain-type, back-ventilated, thermally insulated; 2002.

* cited by examiner

CURTAIN-TYPE FACADE STRUCTURE

The present application claims priority from German Patent Application No. 102006033045.5 filed Jul. 14, 2006, the disclosure of which is incorporated herein by reference.

Curtain-type facade structures comprise a fixedly supported substructure of vertical or horizontal basic profiled supports and crossing horizontal or vertical profiled supports mounted thereon, panel holders which are fastened to the supporting profiles, and facade panels which are retained by means of panel holders. The substructure is preferably supported on a wall or building wall. The facade panels are preferably made of ceramic material, in particular clay or cement.

Facade structures of this construction are known in practice. Such a construction is described, for example, in the Applicant's product brochure "MOEDING ZIEGELFASSADE, Querformat-Ausführung, vorgehängt, hinterlüftet, wärmegedämmt [MOEDING CLAY-TILE FACADE, horizontal format design, curtain-type, back-ventilated, thermally insulated]" published in 2002. The substructure of these described known facade structures comprises vertical basic profiles anchored on the building. The supporting profiles are fastened horizontally on the front side of these basic supporting profiles. The panel holders for the facade panels are suspended on the supporting profiles in a known manner. The panel holders latch with the supporting profile or are firmly connected thereto by means of a rivet or screw connection. The facade panel is fastened here by being supported from below by a U-shaped seat of the panel holder, and a further panel holder secures the facade panel by means of a downwardly open U-shaped holding mount. The upper panel holder is responsible in particular for retaining the facade panel securely against tilting and firmly against shaking. For this purpose, the panel holder must remain adjustable in the vertical direction while the fitting work is taking place or can be fastened to the supporting profile once the facade panels are being fitted. It is therefore conventional and expedient in this facade structure for the facade panels to be mounted on the building from the bottom up.

Also known are curtain-type facade structures in which vertical T- or L-profiles, to which the panel holders are riveted, are fastened to wall angles anchored in the building wall.

The object on which the invention is thus based is to provide a curtain-type facade structure whose facade panels can be mounted simply and time-effectively and are retained against the facade in a wind-resistant manner.

This object is achieved according to the invention with a curtain-type facade structure, comprising a fixedly supported substructure to which panel holders are fastened, and facade panels which are retained by means of panel holders, provision being made for the panel holder to comprise a basic holder and an elastic clip, the elastic clip forming a seat and/or a latching means for the facade panels, provision being made for the basic holder and the elastic clip to be designed as separate components or for the basic holder and the elastic clip to be designed in one piece.

The formation of the panel holder from two components having a separate range of functions offers clear advantages in respect of fitting the facade panels. Because the facade panels are now held by an elastic clip which not only ensures that the facade panels are securely retained in the basic holder but also allows the facade panels to be fitted and removed easily, and because the basic holder assumes the holding function or supporting function for the facade panels, the sequence of work can be structured much more effectively. It is thereby possible, for example, to fit the facade panels in rows from top down such that in this way the disassembly of the scaffolding required for a the fitting operation can start to take place during the actual fitting operation.

The invention is also distinguished by the fact that the facade panels can be fitted in a relatively short period of time. All that is required is to insert the facade panel into the seat of the clip so that the facade panel is at the same time latched in place in the clip. There is thus no need for tools, auxiliary means or additional elements in order to fix the facade panel securely in the panel holder.

The seat of the clip can also be designed as a rigid portion, or at least as a portion of the clip that is designed to have greater spring hardness than the resilient latching element of the clip that allows latching to take place. If then, for example, the basic holder and elastic clip are designed in one piece, the elastic region of the clip may in that case be restricted to a spring element which may be designed, for example, as a leaf spring which is bent at an angle in the free end portion.

Provision may advantageously be made for the elastic clip to latch with the basic holder. This solution makes it possible for the optimum material to be selected for each of the two components of the panel holder—basic holder and clip—and/or allows the optimum functional design. As stated further below, the clip may advantageously be formed from a spring sheet, while the basic holder may be formed as an extruded part which can be formed with a contour having multiple divisions without entailing increased manufacturing outlay. The basic holder may be formed, for example, with latching recesses or undercuts, latching projections, retaining arms and the like. Provision may also be made for the elastic clip and the basic holder to be interconnected with a force fit. To produce a force-fit connection between the elastic clip and the basic holder, it may be envisioned, for example, to use the weight of the hooked-in facade panel.

Provision may be made for the seat formed by the elastic clip to accommodate an end of the facade panels.

Provision may also be made for the seat formed by the elastic clip to be designed to accommodate an upper and/or lower end of the facade panels.

In a further advantageous refinement, provision may be made for the seat formed by the elastic clip to be designed to accommodate a ridge of the facade panels.

Provision may also be made for the seat formed by the elastic clip to be designed to accommodate an upper and/or lower ridge of the facade panels.

Provision is thus made for the elastic clip to be able to be used flexibly as a retaining element for the facade panel, and the use of the elastic clip is not restricted by the configuration and/or the arrangement of the clip on the facade panel.

Provision may be made for the seat formed by the elastic clip to be of U-shaped design to accommodate the facade panels.

Provision may be made for the basic holder to comprise a first upwardly open or downwardly open U-shaped seat for the elastic clip.

In an advantageous embodiment, provision is made for the basic holder to comprise a first upwardly open U-shaped seat for the elastic clip and for a lower end, preferably a lower ridge, of the facade panel. Provision may thus be made for the facade panel to be accommodated not only in the U-shaped seat of the elastic clip but also in the U-shaped seat of the basic holder.

Provision may also be made for the basic holder to comprise a second downwardly open U-shaped seat for an upper end, preferably a ridge, of the facade panel.

In a further advantageous embodiment, provision is made for the basic holder to comprise a first downwardly open U-shaped seat for the elastic clip and for an upper end, preferably an upper ridge, of the facade panel.

Provision may also be made for the basic holder to comprise a second upwardly open U-shaped seat for a lower end, preferably a ridge, of the facade panel.

Provision may also be made for the first U-shaped and the second U-shaped seat of the basic holder to face away from one another but to be arranged with a common horizontal base leg. In this way the two U-shaped seats form an H-shaped seat.

Provision may be made for the elastic clip to have a horizontal leg and an upwardly projecting retaining leg, the retaining leg engaging in a horizontal, preferably rear, groove in the facade panel. In this way not only is the facade panel protected from the effects of external forces which may cause the facade panel to lift out, but it is also possible to replace the facade panel by overcoming the spring force of the retaining leg.

Provision may also be made for the elastic clip to have a horizontal leg and an upwardly projecting latching leg, the latching leg being latched in the basic holder. However, provision may also be made to dispense with the latching leg and to fix the elastic clip in the basic holder by using the weight of the facade panel accommodated by said clip, as also described further above.

In a further advantageous embodiment, provision is made for the U-shaped seat of the elastic clip to be formed by a horizontal leg and two upwardly projecting legs.

Provision may also be made for the U-shaped seat of the elastic clip to be formed by a horizontal base leg and two upwardly projecting U-legs, the first upwardly projecting leg engaging in the facade panel or being designed as a retaining leg, and the second upwardly projecting leg latching with the basic holder.

In a further advantageous embodiment, the elastic clip has a diagonally rearwardly and upwardly projecting leg which latches with the basic holder.

Provision is thus made for the elastic clip to be designed, while maintaining the basic principle, such that it can easily be adapted to different installation conditions and/or facade panels and/or basic holders.

The elastic clip may preferably be formed from a weather-resistant spring material, the spring properties preferably being determined by the modulus of elasticity of the spring material and/or by the structural configuration of the spring elements. The spring elements may be leaf springs which are advantageously formed with a uniform material thickness. The spring material provided may, for example, be a stainless steel, such as VA-steel, or a plastic or a composite material, for example a fiber-reinforced plastic. The elastic clip may advantageously be punched and bent from a spring sheet.

Provision may be made for the fixedly supported substructure to be formed from vertical or horizontal basic profiled supports and from crossing horizontal or vertical profiled supports mounted thereon. It is also possible to provide only vertical profiled supports to which the basic profiled supports are fastened, for example screwed, riveted or clipped in.

Provision may be made for the basic holder to be designed as a rigid holder.

In an advantageously embodiment, provision may also be made for the basic holder to have an elastic portion designed as a latching spring for latching the basic holder in place. Hence, the basic holder can be latched, for example, to a supporting profile such that no further fastening elements are required. Such an elastic design can be achieved by the suitable shaping of materials, including those which are generally not counted among spring materials, such as aluminum or aluminum alloys, for example.

The invention will now be described in more detail with reference to the figures, in which.

Figure 3A:
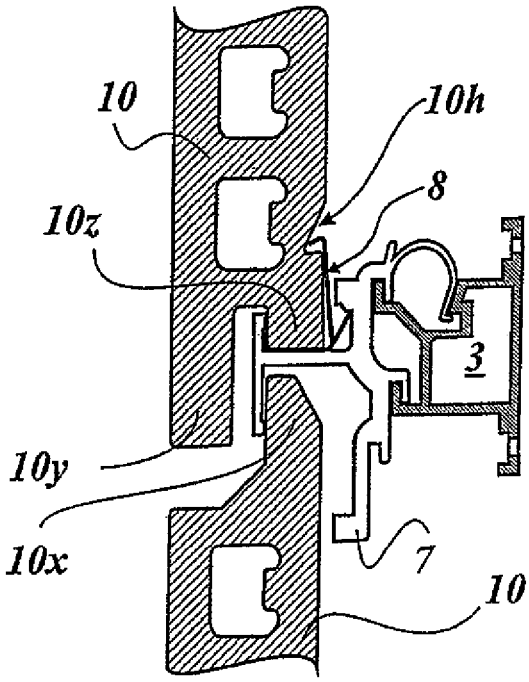
Figure 3B:
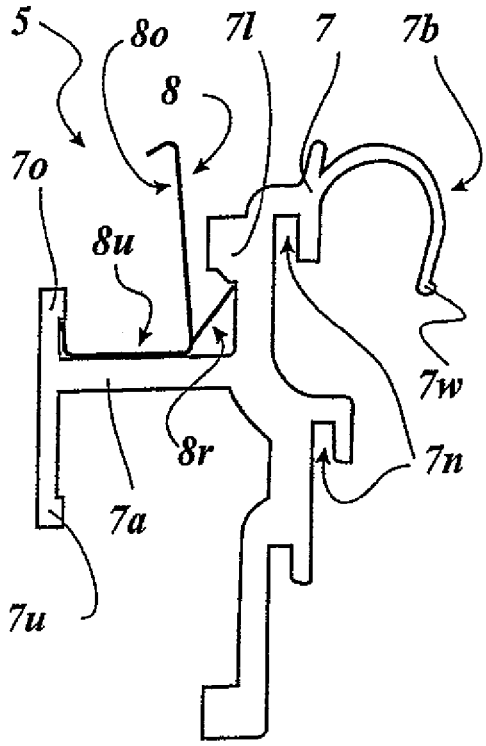

FIG. 3*a* shows a sectional view of a first exemplary embodiment of the facade structure according to the invention;

FIG. 3*b* shows an enlarged sectional view of the basic holder and of the elastic clip in FIG. 3*a;*

Figure 3C:
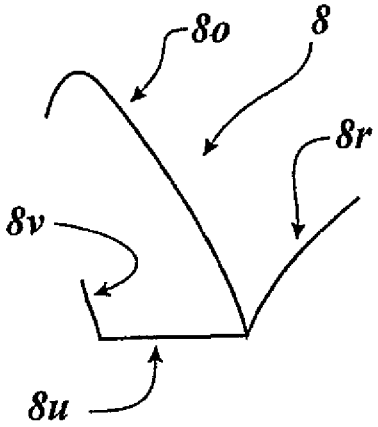
Figure 3D:
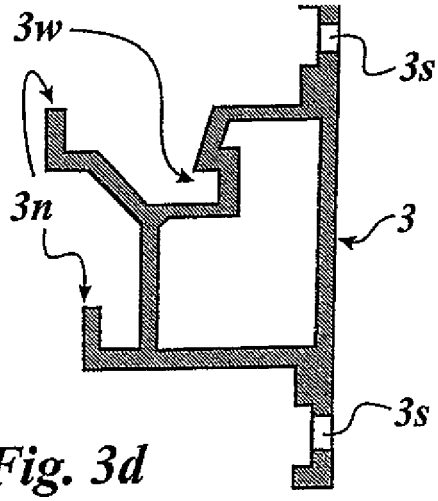

FIG. 3*c* shows a sectional view of the elastic clip in FIG. 3*b* in the as-supplied state;

FIG. 3*d* shows an enlarged sectional view of the supporting profile in FIG. 3*a;*

Figure 4A:
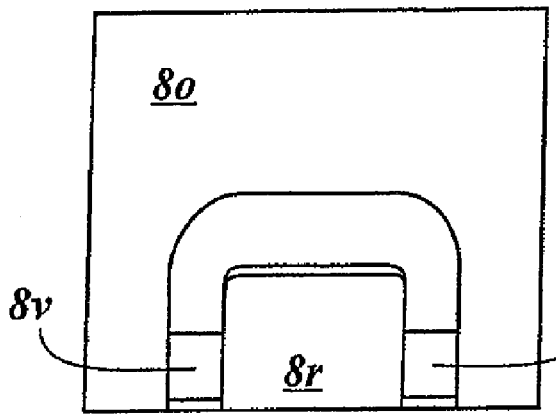

FIG. 4*a* shows a rear view of the elastic clip in FIG. 3*b;*

Figure 4B:
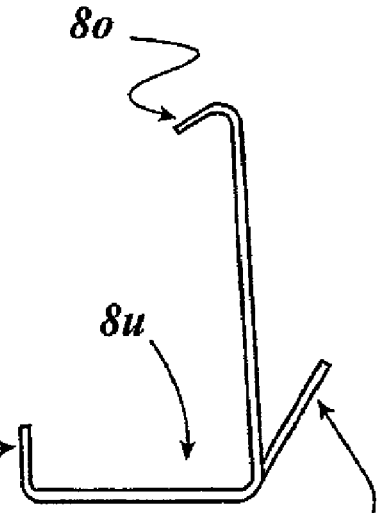

FIG. 4*b* shows a side view of the elastic clip in FIG. 3*b;*

Figure 4C:
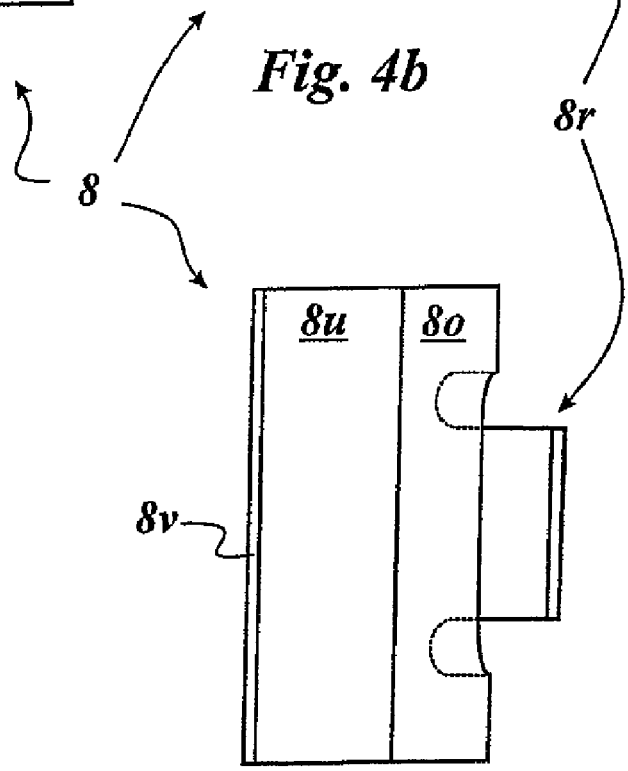

FIG. 4*c* shows a plan view of the elastic clip in FIG. 3*b;*

Figure 5:
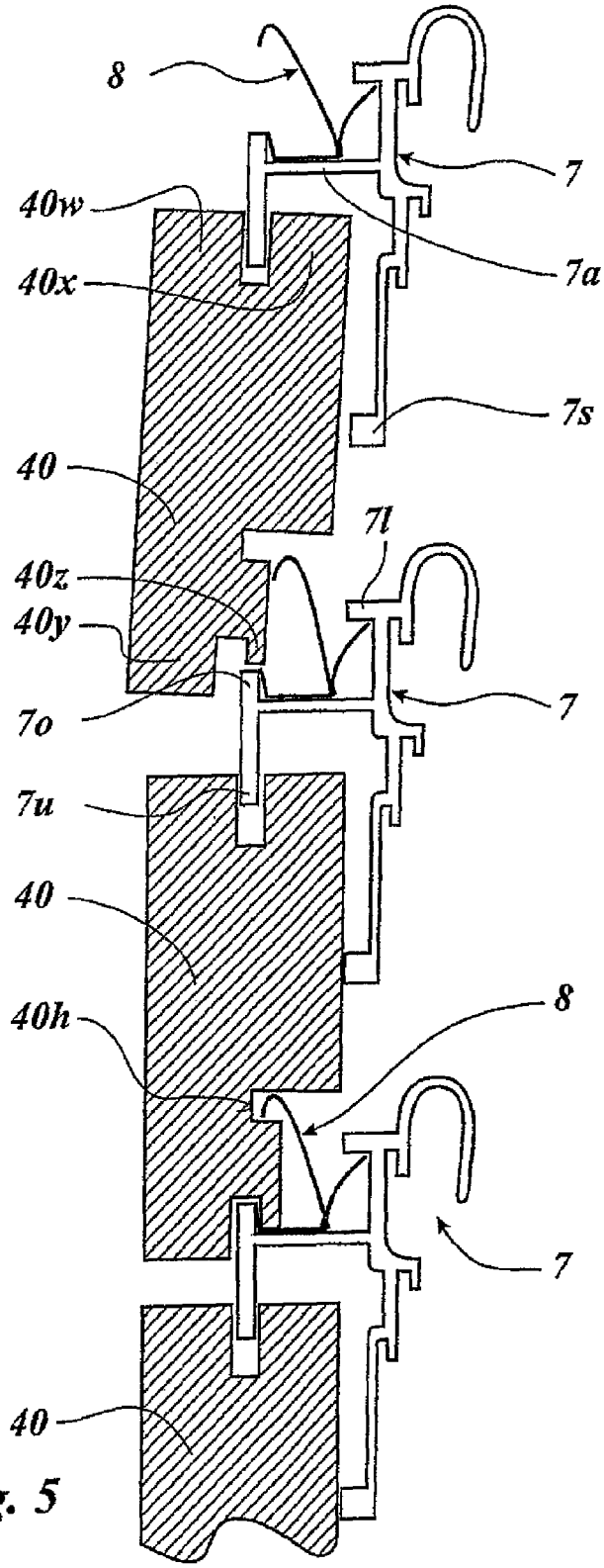

FIG. 5 shows a sectional view of a second exemplary embodiment of the facade structure according to the invention.

Figure 1:
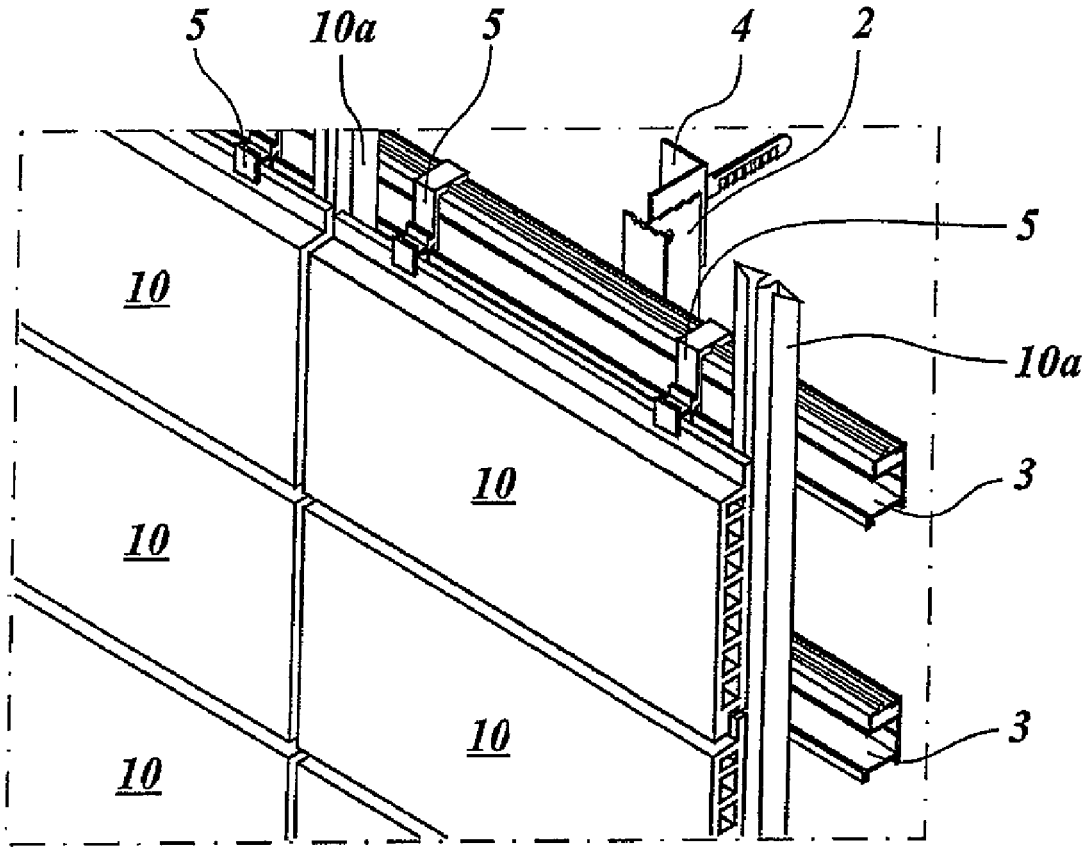
Fig. 1 PRIOR ART
FIG. 1 shows a perspective illustration of a curtain-type facade structure with conventional panel holders that corresponds to the prior art.
Figure 2:
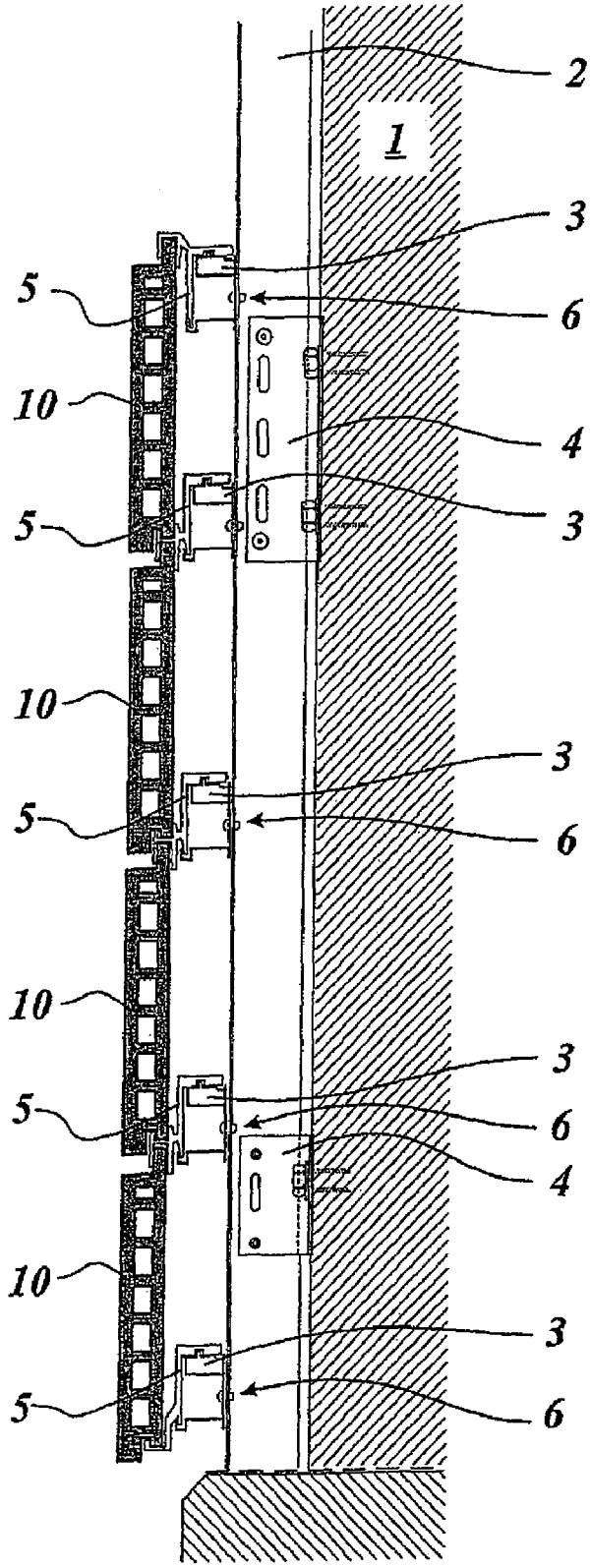
Fig. 2 PRIOR ART
FIG. 2 shows a sectional view of the facade structure in FIG. 1.

FIGS. 1 and 2 show the construction of a curtain-type, back-ventilated facade structure according to the prior art.

Vertical basic profiled supports 2 are fastened to a building wall 1 by means of retaining anchors 4. The retaining anchors 4 are formed with an L-shaped angle profile, one L-leg being connected to the building wall 1 and the other L-leg being fastened to the vertical basic profiled support 2 by means of a screw connection. Horizontal profiled supports 3 are arranged on the vertical basic profiled supports 2 and thus form a substructure for accommodating facade panels 10.

The facade panels 10 are hooked into panel holders 5 which, by way of their upper portion which is bent at an angle, rest with a form-fit connection on the horizontal profiled supports 3. Arranged behind the facade panels 10 are vertically extending joint profiles 10*a* which engage in the vertical joint between two horizontally adjacent facade panels and seal the joint, these joint profiles also pressing the facade panels forward and thus causing the rear head and foot ridges of the facade panels 10, which engage in U-shaped seats of the panel holders 5, to bear against the front inner sides of the seats.

As can be seen from FIG. 2, the prior art facade structure requires that the facade panels be hooked into the panel holders 5 in rows from the bottom up, with the upper panel holders, which engage around the head ridge of the facade panel 10, being fitted on after the foot ridge of the facade panel has been hooked into the lower panel holder. The fact that the horizontal profiled supports 3 are rigidly fastened the vertical basic profiled supports 2 by means of rivet connections 6 means that no other procedure is possible.

FIGS. 3*a* to 3*d* now show a first exemplary embodiment of a facade structure according to the invention.

FIG. 3*a* shows the construction of the facade structure according to the invention, although the vertical basic profiled supports and the building wall are not represented. The facade panel 10 of the facade structure has a rear head ridge 10*x*, a front foot ridge 10*y* and a rear foot ridge 10*z*. It is formed from two panels which are interconnected by webs.

Into the horizontal profiled support 3 is hooked a basic holder 7 which is connected to the basic profiled support 3 with a form fit by means of fastening grooves 7*n* which engage over retaining projections 3*n* formed on the basic holder 7 (see also FIGS. 3*b* and 3*d*). The profiled support 3 has a box profile whose rear wall, which faces the building wall, is formed as a fastening plate which projects beyond the box profile in terms of its width dimensions. Fastening holes 3*s* are made in the two marginal regions of the fastening plate that project beyond the box profile, these holes being provided to receive screws or rivets for fastening the horizontal profiled support 3 to the vertical basic profiled support 2.

The lower and upper walls of the box profile are made to extend beyond the front edge of the box profile and are bent off at an angle to form an L shape. The upwardly pointing shorter L-leg in each case forms one of the retaining projections 3*n* which engage in fastening grooves 3*n* in the basic holder 3.

The basic holder 7, which is substantially formed as a rigid holder in the exemplary embodiment represented in FIG. 3*a*, comprises an arcuate latching spring 7*b* which engages by way of a retaining bead 7*w* in a catch 3*w* formed on the horizontal profiled support. The retaining bead 7*w* is arranged at the free end portion of the arcuate latching spring 7*b*. The catch 3*w* is formed in an upfold of the upper wall of the box profile. The catch 3*w* comprises an insertion slope over which the retaining bead 7*w* slides into the catch 3*w*. The insertion slope makes it possible for the basic holder 7, after it has been hooked into the horizontal profiled support 3, to be latched in by being pressed downward until the retaining bead 7*w* of the latching spring 7*b* latches into the catch 3*w*.

The basic holder 7 further comprises two U-shaped seats having a common base leg 7*a*, these seats thus forming an H-shaped double seat for the facade panels 10. The two front U-legs 7*o* and 7*u* of the seats simultaneously form the front H-leg.

As can be seen in FIG. 3*b*, an elastic clip 8 is arranged in the upper U-shaped seat. The elastic clip 8 comprises a U-shaped seat, formed from a front latching leg 8*v*, a base leg 8*u* and a retaining leg 8*o*. The seat serves to accommodate the rear foot ridge 10*z* of the facade panel 10. The basic holder 7 and the elastic clip 8 inserted into the basic holder 7 perform the function of the panel holder 5 in FIGS. 1 and 2, namely that of retaining the facade panel 10.

The retaining leg 8*o*, in the non-installed state, forms an acute angle with the base leg 8*u* and, in the installed state (FIG. 3*a*), is set further upright. The upper end portion of the retaining leg 8*o* is designed such as to be bent at an angle, the end portion bent at an angle engaging in an undercut in the rear side of the facade panel 10 that faces the building wall. In so doing it exerts a retaining force on the facade panel 10 that results from the spring force of the retaining leg 8*o* deflected from its inoperative position. The undercut has a lower horizontal portion and a portion which is directed obliquely upward toward the rear side of the facade panel. The horizontal portion secures the facade panel against being lifted out of the U-shaped seat of the elastic clip 8, while the obliquely upwardly directed portion transmits the spring force exerted by the retaining leg 8*o* to the facade panel 10.

FIGS. 4*a* to 4*c* now show the construction of the elastic clip 8 in detail. As can be seen in particular in FIG. 4*a* in conjunction with FIG. 4*b*, the rear latching leg 8*r* has been formed by removing a U-shaped region from the retaining leg 8*o*, for example by punching, the two U-legs pointing downward. In this way, the spring characteristic of the retaining leg 8*o* has become "softer" and now, instead of a relatively rigid plate, is formed from two leaf springs which are interconnected by a transversely extending portion. The rear latching leg 8*r* takes the form of a plate and, in the exemplary embodiment represented, is bent rearwardly at an angle to form an angle of approximately 60° with respect to the horizontal. As can be seen in FIG. 3*b*, the rear latching leg 8*r* engages in a corner angle which is formed in the rear wall of the upper U-shaped recess of the basic holder 7.

The elastic clip 8 can be produced from a spring sheet, preferably from a stainless steel sheet, for example from what is known as VA-sheet. The VA-sheet preferably has a thickness of from 0.25 to 0.5 mm. The elastic clip can be produced in two operations—punching and bending—with provision being made, where appropriate, for the cut edges to be deburred following these operations. As can be seen in FIGS. 4*a* and 4*c*, the elastic clip 8 is constructed symmetrically, with the plane of symmetry running through the front latching leg 8*v* and the rear latching leg 8*r*.

FIG. 5 now shows a second exemplary embodiment of the facade structure according to the invention, facade panels 40 being provided which have a front and a rear head ridge 40*w*, 40*x* and a front and a rear foot ridge 40*y*, 40*z*.

FIG. 5 shows three rows of the facade panels 40 arranged above one another, provision being made to fit the facade panels starting at the upper row. This entails first introducing the elastic clips 8 into the upper U-shaped seats of the basic holders 7 and latching them in place.

Then the rear head ridge 40*x* of the upper facade panel 40 is inserted into the lower U-shaped seat of the basic holder 7 and the facade panel 40 is lifted to such an extent that the rear foot ridge 40*z* of the facade panel 40 slides over the front legs of the U-shaped seats of the basic holder 7 and the elastic clip 8. Then the panel 40 is lowered until it bears against the horizontal leg of the U-shaped seat of the elastic clip 8, and the L-shaped end portion of the retaining leg 8*o* of the elastic clip 8 thereby engages in a groove-shaped undercut 40*h* of the facade panel 40 and comes to rest there. The facade panel 40 is already secured by the two-part design of the panel holder formed from the basic holder 7 and the elastic clip 8.

The panel row which is downwardly adjacent to the upper panel row can now be fitted.

FIG. 5 shows the central facade panel and the facade panel arranged below it in the ready-fitted state. If required, for example following any damage, each fitted facade panel can be taken back out of the facade structure, although the possibility of the elastic clip 8 being permanently deformed during the removal operation cannot be ruled out. Therefore, provision may be made, prior to inserting a new facade panel, to insert a new clip 8 into the basic holder 7 as well.

What is claimed is:

1. Curtain-type facade structure comprising:

a substructure to be fixedly supported and to which panel holders are fastened, and facade panels retained by means of the panel holders, wherein each of the panel holders comprises a basic holder and an elastic clip, the elastic clip forming a latching means for the facade panels, wherein the basic holder and the elastic clip are separate components, wherein the basic holder includes a seat for the elastic clip and the elastic clip is for latching with the basic holder, and wherein each of the façade panels includes a horizontal groove in a rear side of the façade panels and wherein a leg of the elastic clip is for engaging in the horizontal groove in the rear side of the façade panels by latching.

2. Curtain-type facade structure according to claim 1, wherein the elastic clip includes a seat to accommodate an end of the facade panels.

3. Curtain-type facade structure according to claim 1, wherein the elastic clip includes a seat designed to accommodate a ridge of the facade panels.

4. Curtain-type facade structure according to claim 1, wherein the elastic clip includes a seat designed to accommodate at least one of an upper end and a lower end of the facade panels.

5. Curtain-type facade structure according to claim 1, wherein the elastic clip includes a seat designed to accommodate at least one of an upper ridge and a lower ridge of the facade panels.

6. Curtain-type facade structure according to claim 1, wherein the elastic clip includes a seat of U-shaped design to accommodate the facade panels.

7. Curtain-type facade structure according to claim 1, wherein the seat of the basic holder comprises an upwardly open U-shaped seat for accommodating the elastic clip.

8. Curtain-type facade structure according to claim 1, wherein the seat of the basic holder comprises an upwardly open U-shaped seat for accommodating the elastic clip and for a lower end of the facade panels.

9. Curtain-type facade structure according to claim 7, wherein the seat of the basic holder comprises a downwardly open U-shaped seat for accommodating an upper end of the facade panels.

10. Curtain-type facade structure according to claim 1, wherein the seat of the basic holder comprises an upwardly open U-shaped seat for accommodating a lower end of the facade panels.

11. Curtain-type facade structure according to claim 9, wherein the upwardly open U-shaped seat and the downwardly open U-shaped seat of the basic holder face away from one another but are arranged with a common horizontal base leg.

12. Curtain-type facade structure according to claim 1, wherein the elastic clip has a horizontal leg and an upwardly projecting retaining leg, wherein the retaining leg is for engaging in the horizontal groove in the facade panels.

13. Curtain-type facade structure according to claim 1, wherein the elastic clip has a horizontal leg and an upwardly projecting latching leg, wherein the latching leg is for being latched in the basic holder.

14. Curtain-type facade structure according to claim 6, wherein the U-shaped seat of the elastic clip is formed by a horizontal leg and two upwardly projecting legs.

15. Curtain-type facade structure according to claim 6, wherein the U-shaped seat of the elastic clip is formed by a horizontal base leg and first and second upwardly projecting U-legs, the first upwardly projecting leg for engaging in the facade panels or being designed as a retaining leg, and the second upwardly projecting leg for latching with the basic holder.

16. Curtain-type facade structure according to claim 1, wherein the elastic clip has a diagonally rearwardly upwardly projecting leg for latching, with the basic holder.

17. Curtain-type facade structure according to claim 1, wherein the substructure is formed from vertical or horizontal basic profiled supports and from crossing horizontal or vertical profiled supports mounted thereon.

18. Curtain-type facade structure according to claim 1, wherein the basic holder is designed as a rigid holder.

19. Curtain-type facade structure according to claim 18, wherein the basic holder has an elastic portion designed as a latching spring for latching the basic holder in place.

20. Curtain-type facade structure according to claim 8, wherein the lower end of a first of the facade panels is a lower ridge.

21. Curtain-type facade structure according to claim 9, wherein the upper end of a first of the facade panels is a ridge.

22. Curtain-type facade structure according to claim 9, wherein the upper end of a first of the facade panels is an upper ridge.

23. Curtain-type facade structure according to claim 12, wherein the lower end of a first of the facade panels is a ridge.

* * * * *

UNITED STATES PATENT AND TRADEMARK OFFICE

CERTIFICATE OF CORRECTION

PATENT NO. : 7,726,083 B2
APPLICATION NO. : 11/777725
DATED : June 1, 2010
INVENTOR(S) : Rudolf Wagner It is certified that error appears in the above-identified patent and that said Letters Patent is hereby corrected as shown below:

Column 2, line 2, delete “a”.
Column 4, line 52, insert --to-- after “fastened”.
Column 8, line 17, “latching, with” should read --latching with--.
Column 8, line 23, delete “12” and insert --10--.

Signed and Sealed this
Twenty-fourth Day of May, 2011

David J. Kappos

David J. Kappos
*Director of the United States Patent and Trademark Office*